United States Patent [19]

Minshall et al.

[11] 4,259,787

[45] Apr. 7, 1981

[54] HINGED CONTAINER FOR BULK CURE OF TOBACCO

[76] Inventors: Ronald H. Minshall; Gary E. Balthes, both c/o Douglas S. Johnson, 133 Richmond St. West, Toronto, Ontario, Canada

[21] Appl. No.: 36,563

[22] Filed: May 7, 1979

[51] Int. Cl.[3] ..... F26B 19/00

[52] U.S. Cl. ..... 34/201; 34/233; 34/225; 56/27.5; 220/4 E; 414/172

[58] Field of Search ..... 34/194, 195, 196, 201, 34/209, 212, 218, 225, 233, 237, 242; 56/27.5; 131/134; 220/4 E, 72; 29/423, 434; 193/120 W; 414/172, 152, 348

[56] References Cited

U.S. PATENT DOCUMENTS

| | | | |
|---|---|---|---|
| 56,861 | 7/1866 | Plany | 34/233 |
| 2,798,784 | 7/1957 | Marshall | 220/4 E |
| 3,834,137 | 9/1974 | Long | 56/27.5 |
| 3,899,836 | 8/1975 | Johnson | 34/233 X |
| 3,935,959 | 2/1976 | Long | 220/22 |
| 3,946,542 | 3/1976 | Long | 56/27.5 X |
| 4,021,928 | 5/1977 | Johnson | 34/201 X |

FOREIGN PATENT DOCUMENTS

| | | | |
|---|---|---|---|
| 129991 | 11/1959 | U.S.S.R. | 34/192 |

*Primary Examiner*—Albert J. Makay
*Assistant Examiner*—Harold Joyce

[57] ABSTRACT

A system for minimizing manual handling of tobacco leaves for bulk cure comprises a container for use in forced air curing of tobacco in bulk, a kiln having a floor arrangement to effect better control of air flow in achieving forced air cure in such containers and apparatus to facilitate handling of containers from the field, placement in and removal from a kiln. The bulk cure container sidewalls have a plurality of projections to define internally of the container a plurality of obstructions which impede the flow of air along container sidewall interior filled with tobacco in bulk form. The kiln has a floor arrangement which provides a plurality of cavities adapted to sealingly engage container bottoms. The apparatus for handling the containers includes a mobile frame supporting a pair of spaced-apart rails. Such rails cooperate with corresponding pairs of rails in kiln so as to be interconnectable therewith. A travelling crane rides on the rails and serves to lift a loaded container, transport it in its upright position and deposit it in an unoccupied kiln cavity.

30 Claims, 12 Drawing Figures

HINGED CONTAINER FOR BULK CURE OF TOBACCO

FIELD OF THE INVENTION

This invention relates to various aspects of a system for bulk cure of tobacco. Components of the system include containers for the bulk cure of tobacco, kiln and apparatus for transporting and locating containers in such kilns.

BACKGROUND OF THE INVENTION

It is becoming increasingly popular to use various types of mechanical equipment to pick tobacco, to transport picked tobacco in bulk form and to cure tobacco in bulk form by forced air. In the picking of tobacco, several acceptable tobacco harvesters are available, such as that disclosed in Long, U.S. Pat. No. 3,834,137 and Applicant's U.S. patent application Ser. No. 912,428 U.S. Pat No. 4,192,124. In handling the tobacco leaves for purposes of cure, several advances have been made over the customary tying of tobacco leaves to a stick. An example involves the use of tobacco racks, such as that disclosed in Wilson, U.S. Pat. No. 3,083,517. Recently, the principle of tobacco curing using racks has been improved upon by the development of bins which provide for the forced air cure of tobacco in contained bulk form. Examples of such types of bins are disclosed in Long, U.S. Pat. No. 3,834,137 and subsequent U.S. Pat. No. 3,935,959.

Several developments have been made in the design of a kiln for use in curing tobacco. The most significant advance is in the forced air cure of tobacco involving low profile kilns having a plenum beneath the floor which forces air upwardly through the racked or contained bulk form tobacco leaves to effect a cure under controlled humidity and temperature conditions. An example of such kilns is disclosed in Long, U.S. Pat. No. 3,834,137. Not all forced air systems, however, have a plenum, because the structure is completely opened at the bottom where the racks are supported above kiln base. Rather extensive crane arrangements have been used in association with such kilns to effect positioning of these very heavy containers and racks in kilns. Such crane systems may be that shown in Long, U.S. Pat. No. 3,834,137, which requires the location of a heavy beam extending the length of the ceiling of the forced air kiln.

To avoid the use of cranes in loading the bins, or bulk form containers in the kiln, the bins may be provided with wheels on their base, such as in Long, U.S. Pat. No. 3,834,137. The wheels ride on rails located on each side of the kiln to permit rolling of the loaded bin into position. This however, has the significant drawback in that the rollers on the bins, as used in the field, are exposed and subject to damage. Further, in rolling these very heavy bins into the kiln, as they extend the width of the kiln, requires a great deal of effort and in instances where such bins have open bottoms, the leaves are free to drag and become caught in the rails which can further hamper the ease with which the bin may be inserted in the kiln.

A further drawback with containers which have completely open bottoms is that with perforated kiln floor panel designs, the leaves are free to drag on the panels and, therefore, are free to clog the perforations in the floor which can hamper kiln cure effectiveness.

With the open design for kiln floors, reliance is placed on sealing between containers and sealing between container and kiln walls to ensure an upward flow of air through the contained bulk cure form of leaves. There is, therefore, a significant problem with misaligned containers not providing the proper seal, due to sloppy fit of rollers on track or presence of foreign material between contacting bin edges. Sealing flaps along kiln walls may lose their posture, thereby not forming a seal with container edge. A free flow of air is allowed to move through these unsealed areas, thereby reducing the amount of air flowing through the containers resulting in an uneven cure of the tobacco in the kiln and may in some instances spoil a substantial amount of the bulk form tobacco. This arrangement, therefore, substantially reduces the efficiency of forced air kilns.

An additional problem in relying on alignment between abutting surfaces of containers to provide a seal is that over time with usage, some of the containers can become warped their sealing edges damaged, or with the very long narrow type of container, the top plate, which abuts a top plate of other containers such as disclosed in Long, U.S. Pat. No. 3,834,137, tend to bow. As a result, spaces will form between container sealing areas. These aspects, therefore, further contribute to inefficiency of forced air kilns. Further, the use of wheels which elevate containers above a kiln floor permit the air to travel in any direction on emerging upwardly through the floor. The air will seek a path of least resistance to upward movement, whether it be an unsealed area of the containers or a container which has developed a channelling problem to thereby decrease the efficiency of the cure. Conditioning is another consideration which cannot be accomplished with containers on wheels, because if one or more of the bins are removed from the kiln, conditioning cannot be continued for the remaining bins since the air will now travel freely through the open space. This presents a problem when it is not possible to transfer all tobacco from the kiln to the stripping room for grading and bailing within a period which will maintain the desired moisture content in the tobacco remaining in the kiln. Therefore, it is desirable to either provide apparatus to expedite removal of conditioned tobacco from a kiln before it commences drying out again, or provide a kiln floor which would permit conditioning of containers remaining in the kiln while some have already been removed.

In an attempt to achieve a better distribution of leaves in containers, it was proposed by Canadian Tobacco Research Group, as reported in the Canadian Tobacco Growers July, 1978, that the container for use in bulk cure of leaves be hinged at its mid-portion to provide two sections which may be folded towards one another and held closed after fill. This results in filling container sections of lesser depth, so that a more uniform density of leaves may be attained in the container.

A further drawback with containers for bulk cure of tobacco is that it usually requires an individual present at the rear of the mechanical harvester to ensure a uniform distribution of leaves within the container. Also, such containers have smooth sidewalls so that when positioned in the kilns, the forced air may readily pass upwardly along the smooth sidewalls, where there is a lesser density of leaves resulting in channelling. Such channelling can have a very undesirable effect on the cure of tobacco in the immediate area, such as premature greening and in areas of the container where less air flows, there can be stem rot and swell stems which spoil that portion of the tobacco.

An additional drawback of bulk form containers is the fact that the corners in the containers are square and, due to the natural resiliency of the leaves when placed in the container, a lighter density of leaves occurs in the corners which again contributes to channelling within the containers when positioned in a kiln. Such containers are also costly to manufacture, involving several welding operations to attach sidewalls to bottom walls. Also a rather loose arrangement has been provided for spike members which hold the bulk form leaves in position, such as that referred to in Long, U.S. Pat. No. 3,935,959. That spiking arrangement relies on the pins passing through a screen intermediate of the container to hold them in position and ensure proper securement.

It is, therefore, an object of this invention to provide a system for handling and curing tobacco which overcomes or avoids a number of the above problems.

SUMMARY OF THE INVENTION

Several advantages of the system are realized in the bulk cure container of the invention for tobacco leaves which substantially reduces the likelihood of channelling. The container comprises sidewalls with top and bottom adapted to permit a flow of forced air through the container. The sidewalls have a plurality of projections which define internally of the container a plurality of obstructions to impede the flow of air along container sidewall interior when loaded in bulk form with tobacco leaves. Such projections may be integrally formed in the sidewall by metal roll forming techniques to substantially reduce the cost of manufacture of a bulk tobacco cure container. In addition, such container may include rounded corners to achieve a more uniform distribution or density of leaves throughout the contained bulk form. The container may comprise two sections which are connected by a common hinge and which lie on their backs during loading on a harvester.

A further aspect of the system is in the design of the kiln floor which is arranged to provide perforated floor supported above an air plenum. Means is provided to effect a seal between each container base and perforated floor, so that essentially all pressurized air passing through a particular portion of the perforated floor is directed upwardly into the base of a correspondingly located container. The bulk tobacco has been loaded in the container, such that all leaves are oriented generally vertical. This arrangement for the kiln floor, therefore, provides the curing of containers individually of one another, due to the sealing means isolating the curing air for corresponding container. The floor arrangement may include a grid network which overlies the perforated floor to define a plurality of compartments or cavities. Each compartment is dimensioned to receive a bottom of a bulk cure container, where the sealing means effects a seal between container base and the floor within each compartment.

A further aspect of the system resides in a travelling crane which may be used in association with a mobile frame for purposes of loading and unloading the containers into and from a kiln. The kiln floor is provided with rails which extend from the entrance of the kiln to its back. The mobile frame has a pair of rails which are arranged so as to be operatively engagable with a corresponding pair of rails in the kiln. The crane is provided with wheels associated with its depending legs for rolling engagement with the rails. The crane is used to raise a bulk loaded container from the mobile frame, transport it into a kiln and lower the container onto a desired floor location between the rails. If there is a grid network in the kiln, the rails of the kiln and other members of the grid network which define container base receptacles or cavities may have sloped surfaces so as to guide the lowering of container bottom into an unoccupied cavity to effect better sealing engagement with the kiln floor.

These aspects of the invention, in combination with the use of a mechanical harvester automatic leaf distributor, provides a system which substantially minimizes the need for manually handling the leaves from the point of harvesting tobacco to unloading cured tobacco from the kiln.

BRIEF DESCRIPTION OF THE DRAWINGS

Preferred embodiments of the invention are shown in the drawings wherein.

DETAILED DESCRIPTION OF THE PREFERRED EMBODIMENTS OF THE INVENTION

Figure 1:
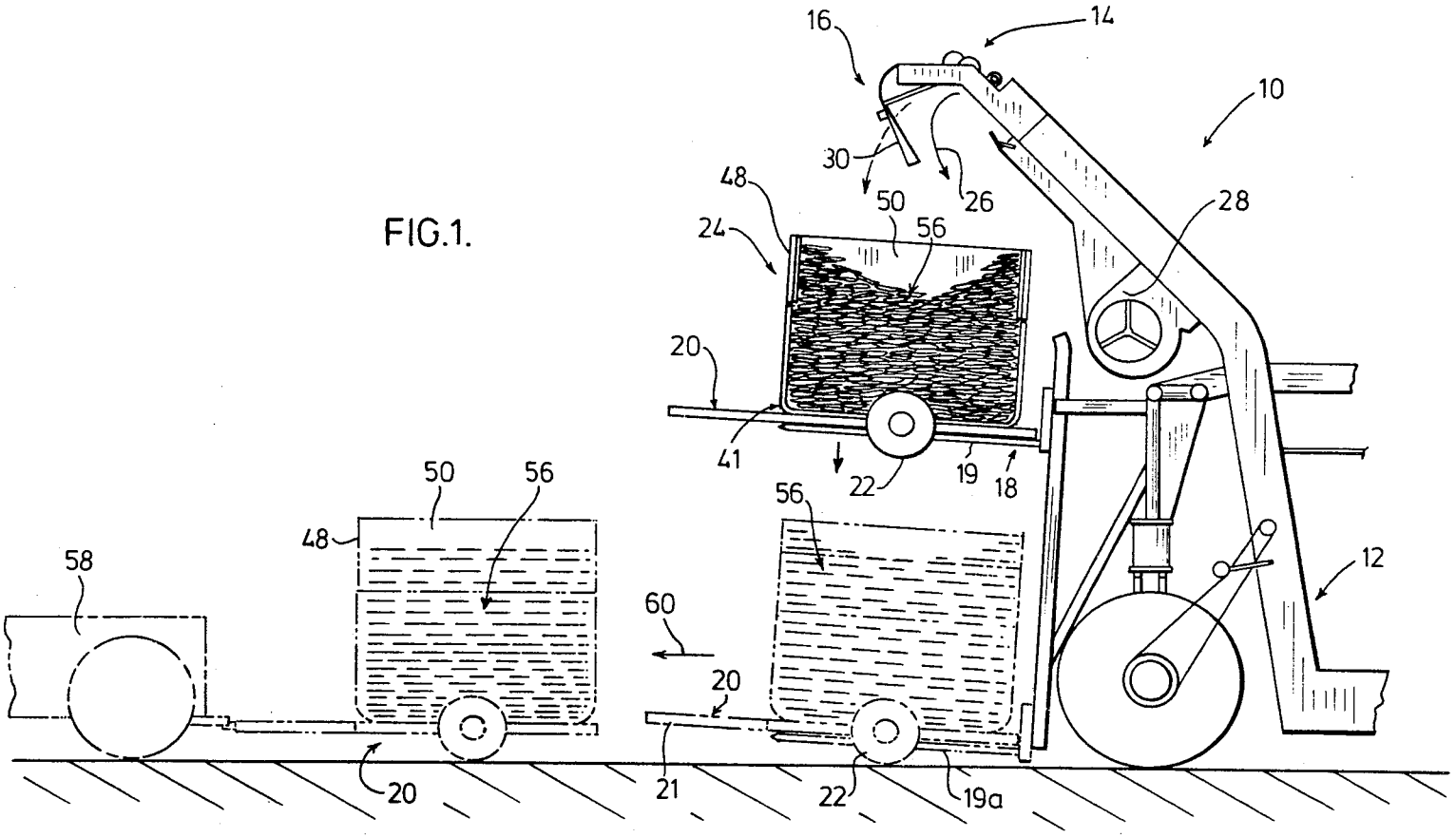
FIG. 1 is an elevation of the rear portion of a harvester which is distributing leaves in a container resting on an elevated trailer and, as shown in shadow, a sequence of lowering the trailer and towing away.

To demonstrate various aspects of the preferred embodiments of this invention, the system for substantially minimizing the manual handling of tobacco leaves commences with respect to the field operation as shown in FIG. 1. At field operation, a mechanical harvester travels over a field removing tobacco leaves from rows of plants. The harvester may be of the type disclosed in Applicant's co-pending U.S. patent application Ser. No. 912,428. In FIG. 1, the rear portion 10 of the harvester is shown where leaves, which have been removed from plants, are conveyed rearwardly and upwardly of the harvester by conveyance means generally designated 12 and which have been described in more detail in our co-pending United States application. The removed leaves are conveyed upwardly and discharged from the conveyor mechanism in the area generally designated 14, where a leaf distributor mechanism 16 is provided. Elevated at the rear of the harvester on a forklift mechanism, generally designated 18, is a trailer 20 supporting a container or bin generally designated 24 to receive the removed leaves in bulk form.

The leaf distributor, as described in more detail in Applicant's co-pending U.S. application Ser. No. 033,485, serves to distribute leaves in the container 24 by use of a flow of air moving in the direction of arrows 26 generated by fan 28. The tobacco leaves, as they emerge from the discharge of the conveyor 12, follow the flow pattern of the air, as determined by a movable deflector plate 30, to distribute the leaves about the bin 24. The deflector plate 30 may be reciprocated back and forth across the bin 24. The movement of the deflector plate determines the extent of piling of the leaves about the container. In reciprocating the deflector plate, a mechanism may be devised which provides a dwell for plate movement at each of its extremities of swing, so that a higher density of leaves is built up along the sidewalls to thereby provide a somewhat concave piling of the leaves in the bin, as demonstrated in FIG. 1. As a result, the density distribution of leaves in the bin takes on a higher value along the sidewalls and along the base of the bin. The advantages of providing this higher density of leaves along the sidewalls and base of the bin will become apparent in the detailed discussion of tobacco bulk cure with regards to FIG. 10.

Figure 2:
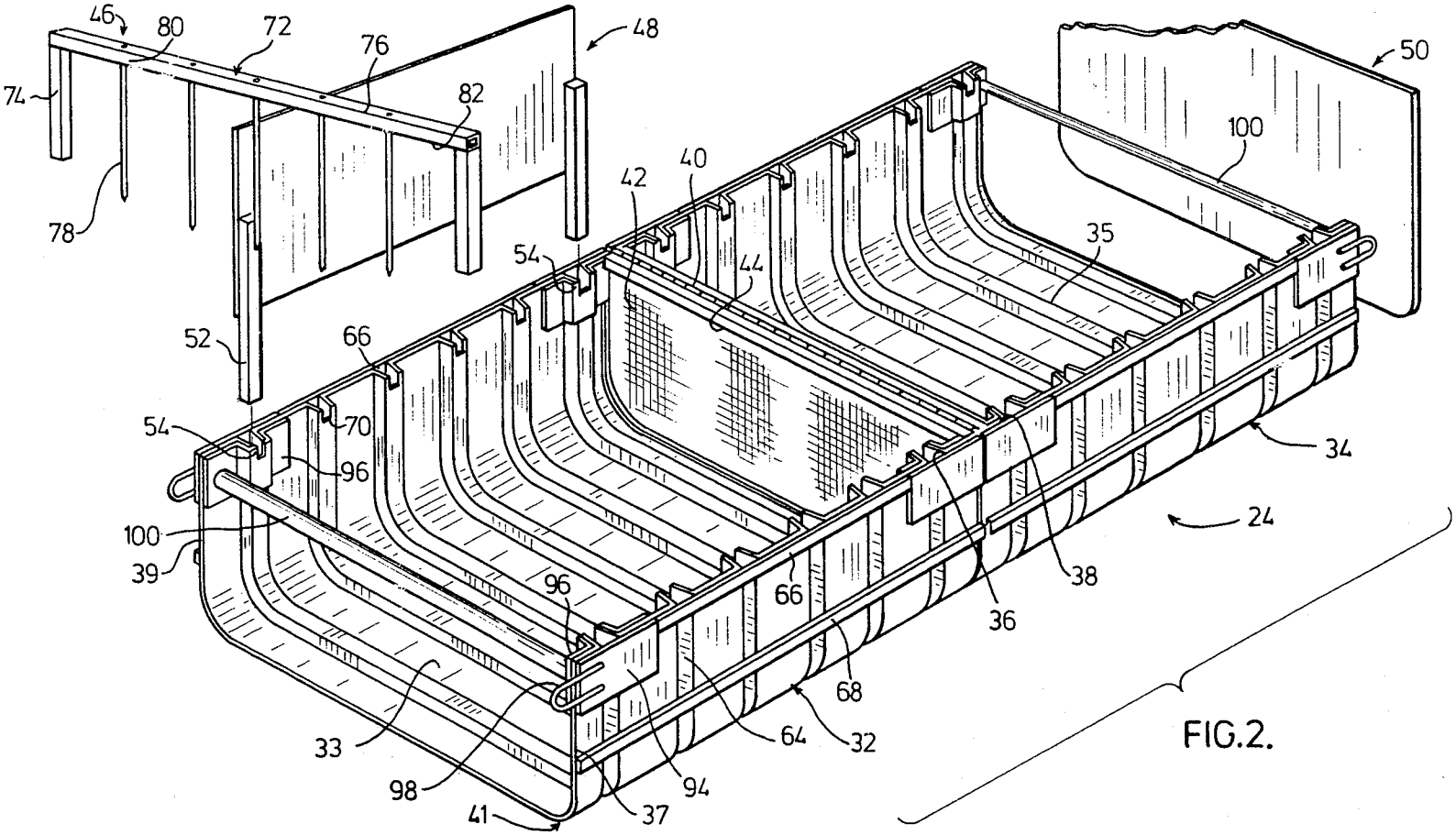
FIG. 2 shows a container having hinged sections in the open position ready for receipt of harvested tobacco leaves.

Referring to FIG. 2, a preferred type of bin is shown in which a more uniform distribution of leaves may be attained with mechanical type of leaf distributors. The bin 24 comprises two sections 32 and 34. The sections are connected at their aligned ends 36 and 38 by a common hinge, preferably piano hinge 40. The aligned ends of each section are covered by a wire mesh 42 which is secured by flanges 44, extending about the perimeter of the sections and underlying the piano hinge 40. After the container 24 is loaded with tobacco leaves in bulk form, spiking devices 46 are inserted into the bin to pierce the leaves in bulk form so that the leaves are held in the bin oriented in generally vertical planes when the sections are hinged towards one another and held closed for purposes of tobacco cure. In closing the bin, the bottom is adapted to permit passage of forced air therethrough, where the wire mesh 40 retains any loose leaves in the bin base to prevent them clogging the floor of the kiln. The screen also contains the leaves so that they do not drag on the floor which could damage the leaves. The so-formed top of the bin is totally open to permit exhaust of forced air having passed through the bulk form of tobacco.

For purposes of field use, the container 24 lies in the position as shown in FIG. 2 on the trailer 20. Due to leaf settling as it is distributed in the bins, it is important to pile the harvested leaves to height greater than the depth of the bin 24. To accomplish this, charge or loading plates generally designated 48 and 50 are removably secured to the bin to permit filling the bin to a level determined by the height of the charge plates. Charge plate 48 includes standards 52 which are supportingly received by sockets 54 provided in the bin sidewall. The end charge plates 50 may also be suitably, removably attached for purposes of loading the bin. A charge plate, although not shown, is arranged to extend along and above the hinged portion 40 to separate leaves dropping into now formed two compartments of the bin sections 32, 34.

The tobacco harvester 10 is moved along the tobacco rows to remove leaves where the distributor 16 distributes leaves in bulk form, as generally designated 56 in the so-formed compartments of sections 32, 34, to a level which may be as high as the charge plates. On attaining a full bin of bulk cure form leaves 56 with charge plates in position, the forks 19 of the forklift mechanism may be lowered to the position in dot **19*a*, whereby the trailer wheels 22 contact the ground. The harvester is moved forward of the trailer and a tractor 58 is backed up to the trailer 20 and connected to the trailer tongue 21 to draw the trailer away in the direction of arrow 60. As shown, settling of the bulk form of leaves 56 has already begun in the moving trailer. All the while, the leaves are settling in the container 24, they are generally lying flat on the base 33 and 35** of each section compartment.

As shown in FIG. 2, the base 33 of each compartment merges upwardly into uprights 37 and 39 where the corners of each U-shaped section are rounded in the area 41. The rounded portions 41 of each container avoid low leaf density in the container corners when using mechanical or manual distributors. This is due to the fact that, when distributing leaves in the container, the leaves will not always fall in the proper orientation to properly fit within a square corner. In some instances, the leaves may extend in the direction of the periphery of the shell and, as a result, have to bend into the corner. Further, the leaves may be at angles to the corners, so that a rounded corner permits a better packing of leaves without leaving any blank or open spaces which could be interconnected along the length of bin corners. As a result, the bin structure in this regard improves upon existing known bins having square corners to avoid low leaf density areas in the container in bulk form and thereby enhance the forced air curing efficiencies.

Figure 3:
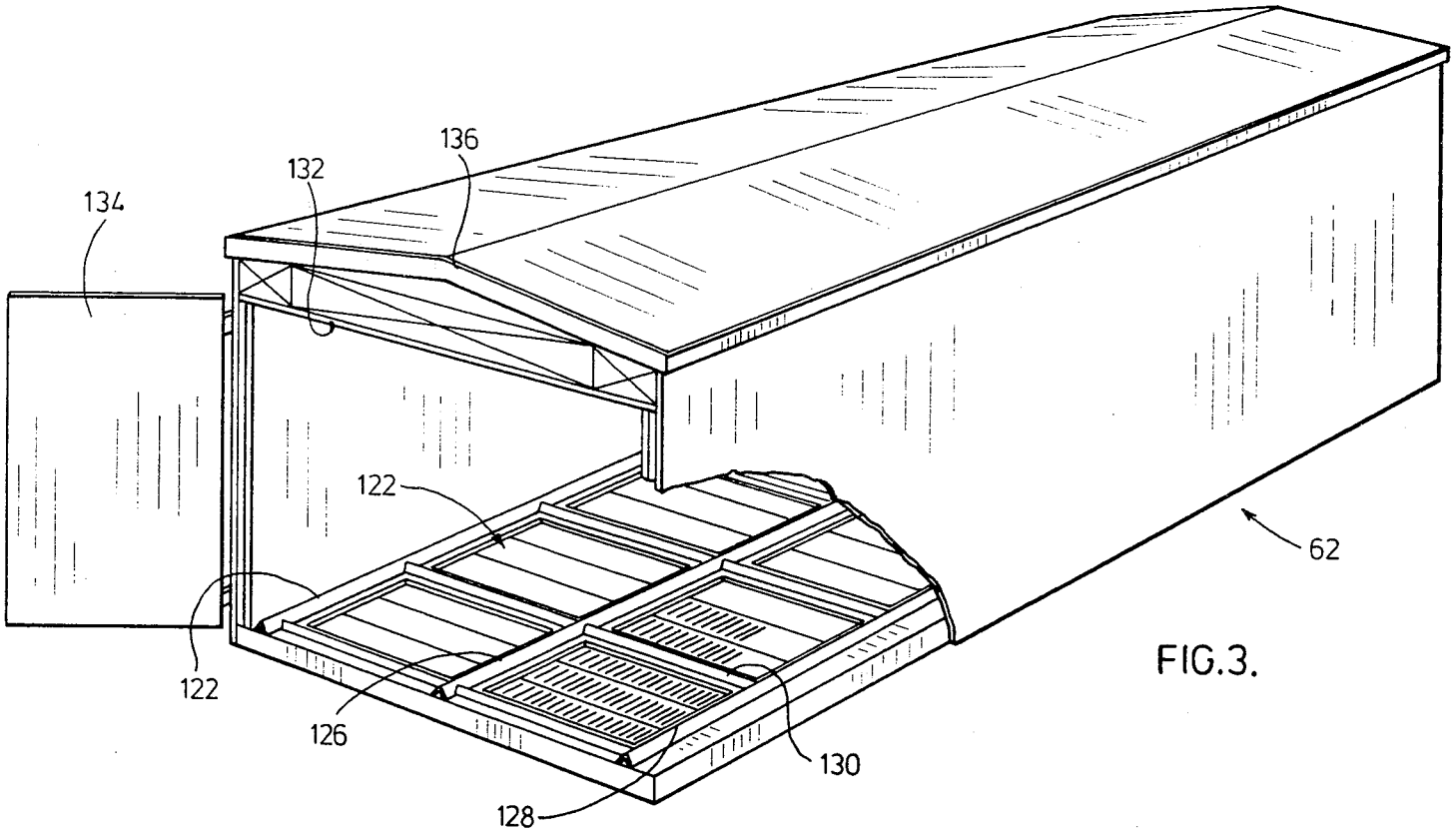
FIG. 3 shows a forced air kiln which incorporates an embodiment of the floor arrangement for use in containerized bulk cure of tobacco.

After the container has been transported to the kiln, such as the kiln 62 shown in FIG. 3, the charge plates 48 may be removed from the container because normally at this point, the leaves have had an opportunity to properly settle to a level proximate the height of the sections. The insertion of the spiking members 46 is fairly convenient due to the unique provisions on the perimeter of the container sidewall. As shown in FIG. 2, a plurality of channel-shaped recesses 64 extend about the perimeter of each section. Secured over each recess are spaced-apart parallel straps 66 and 68. On the now upper edge of each recessed sidewall portion is a notch 70. The spiking members 46 are made up of a supporting frame 72 having legs 74 and base member 76. A plurality of spike members 78 are secured at their root portions 80 to the base 76. The spiking devices are inserted into the bulk form tobacco by placing the leg portions 74 of the frame into the sockets formed by the straps 66 and 68. The plate or strap members 66, 68 confine the legs 74 in the recesses as they move therealong. The notches 70 accommodate the end portions 82 of each frame base so that the upper portions of the base 76 are flush with the upper surface of each container section.

Figure 9:
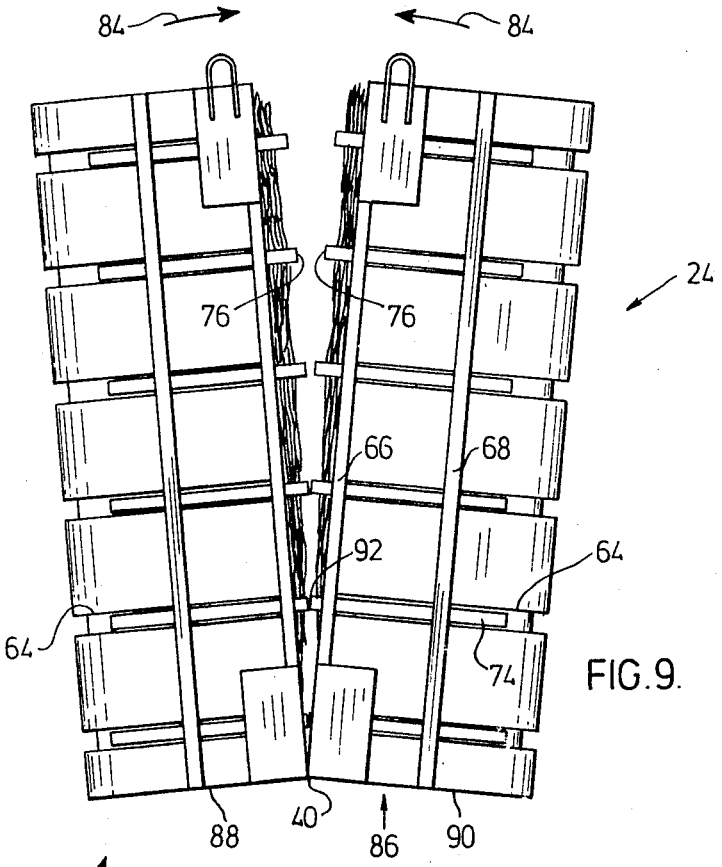
FIG. 9 shows the hinged container being closed.

No provision has been made to hold the spiking members 46 in the bulk tobacco when inserted into the container, for reasons which become apparent in FIG. 9. The container sections are folded upwardly towards each other in the direction of arrows 84 about the common hinge 40 to present the container bottom generally designated 86 of portions 88 and 90, whereby the screen or wire mesh 42 in the bottom of the sections is now across the entire base 86 except for the area of the hinge portion 40. Due to the symmetry of the formed container, the recesses 64 of each section become horizontally aligned so that any protruding base portions 76 of each spiking device abut one another, as shown in the area 92 during the closure of the container 24. This causes any such spiking members, as their bases 76 become flush with section edges to move further into the bulk form tobacco as evidenced by the graduated relative positions of spiking legs 74. As a result, when the container sections are completely closed and clamped in position, all of the spiking members extend into the container and through the bulk form tobacco in the manner shown in FIG. 10. The spiking members and spikes 78 are all essentially horizontally oriented as they hold the bulk form tobacco leaves 56 generaly vertical to permit passage therethrough of forced air during the cure. In order to counteract the movement created by the weight of the bulk form tobacco, as exerted on the spike support members, the rail members 66, 68 confine the spike device legs in the recesses. Due to the legs mating engagement, the horizontal position of the spiking members 78 is retained under the weight of the bulk form tobacco.

As shown in the preferred embodiment for the bin structure in FIG. 2, the bin sections 32, 34 may be roll formed. This is a significant advantage over known containers because substantial economies in the manufacture of the bin are now realized by this particular bin section configuration. The bin section 32 has the channel-shaped recesses 64 roll-formed therein from a sheet of material. Depending upon the width of the roll-forming press, the section 32 may be made up of two sheets which have been riveted together or made up of a single sheet. The roll-formed panel may be subsequently bent to provide the rounded corners 41 for each section. The straps 66, 68 are secured along with the plates 94 and inner plates 96, which provide additional support needed for the charge plates. In addition, secured to the plates 94 are eyelets 98 to which crane cable or the like may be attached for purposes of folding the bin in the manner demonstrated in FIG. 9.

Therefore, an economical method of making containers adapted for use in the bulk cure of tobacco is achieved by roll-forming the two essentially identical container sections with a plurality of longitudinally extending, in this embodiment, channel-shaped recesses. The sections are bent into a U-shaped section, as shown, where the recesses form projections on the inside of each section with the resultant rounded corners 41. The sections may then be connected at their aligned ends by the common hinge 40. To add additional support to the outer ends of the bin, support cross-brace members 100 are provided and secured to the plate members 94, 96. Subsequently added to the so-formed sections are the strap members 66, 68 which serve to confine the legs of the spiking members used to hold the bulk form tobacco in the containers when positioned upright.

Figure 4:
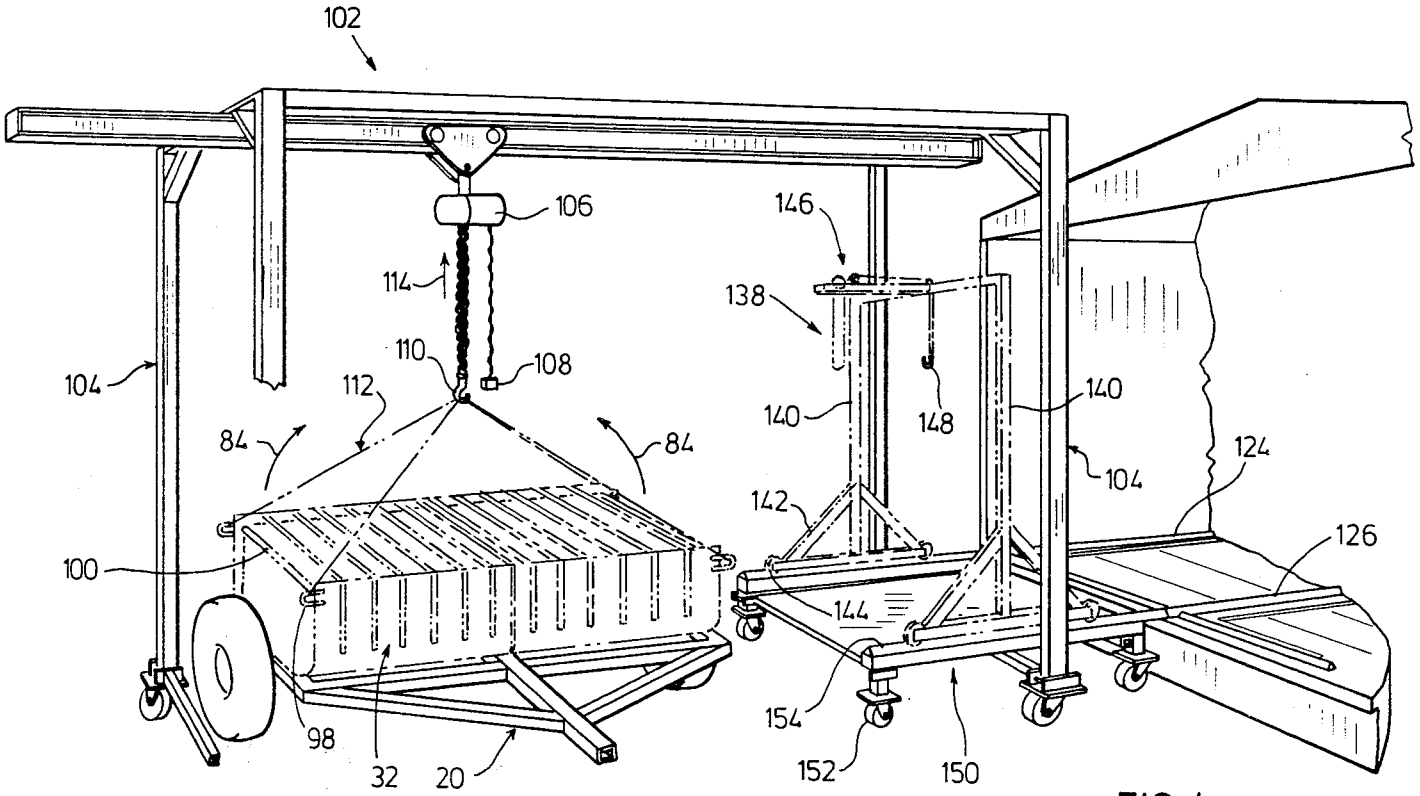
FIG. 4 shows apparatus for closing a hinged container and transporting it into the kiln of FIG. 3.

Once the spiking members are in position and the charge plates are removed, as already demonstrated in FIG. 9, the container sections 32, 34 are folded towards one another. A preferred type of mobile overhead crane having wheels 120 for accomplishing bin folding, is shown in FIG. 4, where the overhead crane 102 has depending support members 104 which are spaced sufficiently far apart to permit an operator to bring the trailer 20 under the crane 102. The crane includes an electric winch 106 operated by remote control 108. Secured to the winch hook 110 is a spider cable arrangement 112 which has four lengths, each secured to an eyelet 98 of each container corner and commonly secured to the hook 110. On raising the winch 106 in the direction of arrow 114 by operating control 108, the bin sections are folded towards each other in the directions of arrows 84 to ultimately achieve the position shown in FIG. 10, where the sections abut one another along their edge portions 116 and 118 with all spiking devices in position. The abutting edges 116, 118 are sufficiently airtight to minimize any upwardly flowing curing air to escape through the bin section sidewall joints. A clamp or the like may be used to hold the container sections together in the closed position by engaging the cross-brace members 100. In elevating the container sections to closed position, the container section bases 88 and 90 seek a horizontal position due to the weight of the held bulk material, thereby assisting in the closure of the container once the useful effectiveness of the crane drops off in raising the sections. Therefore, a simple application of a clamp or the like to achieve final bin closure is greatly simplified by this particular bin arrangement.

As shown in FIG. 3, the kiln 62 has a compartmentalized flooring arrangement providing rows of plurality of compartments generally designated 122. The compartmentalized aspect of the flooring is formed by longitudinally extending partitions or dividers 124, 126 and 128 and cross-members 130 to define two parallel rows of compartments. The entrance 132 to the kiln may be closed off by hinged door 134. The roof structure 136 of the kiln is of standard construction and free of any overhead rails or the like which were necessitated by prior art arrangement for cranes in positioning containers in the kiln. Instead, container positioning in compartments 122 of the kiln 62 is achieved by the use of a travelling crane which is of the gantry type, generally designated 138 and shown in FIG. 4. The crane has depending legs 130 which have associated therewith frame support member 142 having a pair of spaced-apart rollers or wheels 144. On the overhead of the gantry crane, there is mounted a winch generally designated 146 with hook portion 148 for lifting the closed containers.

Figure 8:
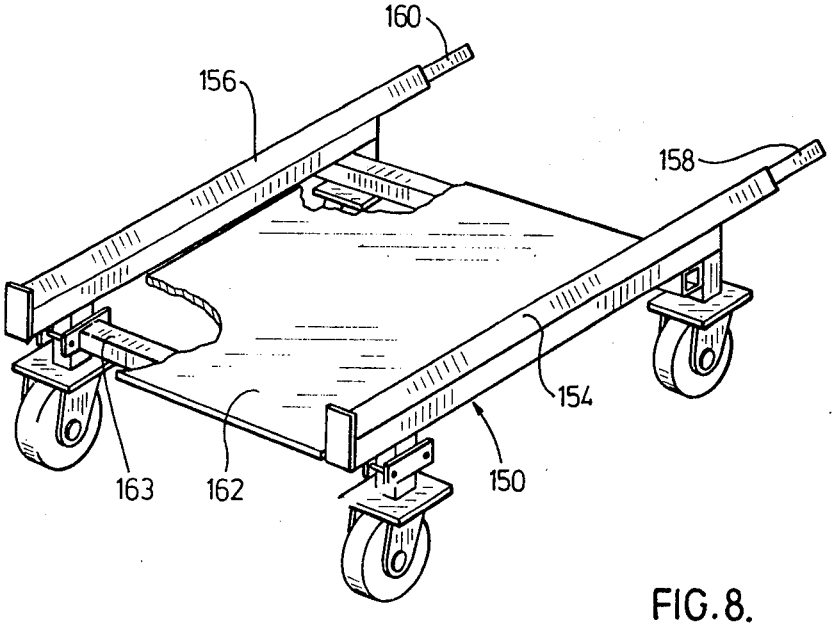
FIG. 8 shows the mobile frame for the travelling crane with removable platform in place.

The divider members 124, 126 and also 128 may define ridges as formed of inverted angle iron or the like which defines in essence a rail or track for the gantry crane 138. Such rails 124, 126, 128 extend the length of the kiln. A mobile frame 150, having wheels 152, is associated with the gantry crane. Secured to the frame 150 is a pair of spaced-apart rails 154 which can be operatively interengaged with the rails 124, 126. The manner in which this can be accomplished is shown in more detail in FIG. 8 of the drawings where the rails 154, 156 include reduced end portions 158, 160 which telescope within a corresponding pair of rails 124–126 or 126–128. A platform 162 is removably located on the mobile frame 150, on which a bulk loaded container may rest in readiness for lifting by the gantry crane 138.

Figure 5:
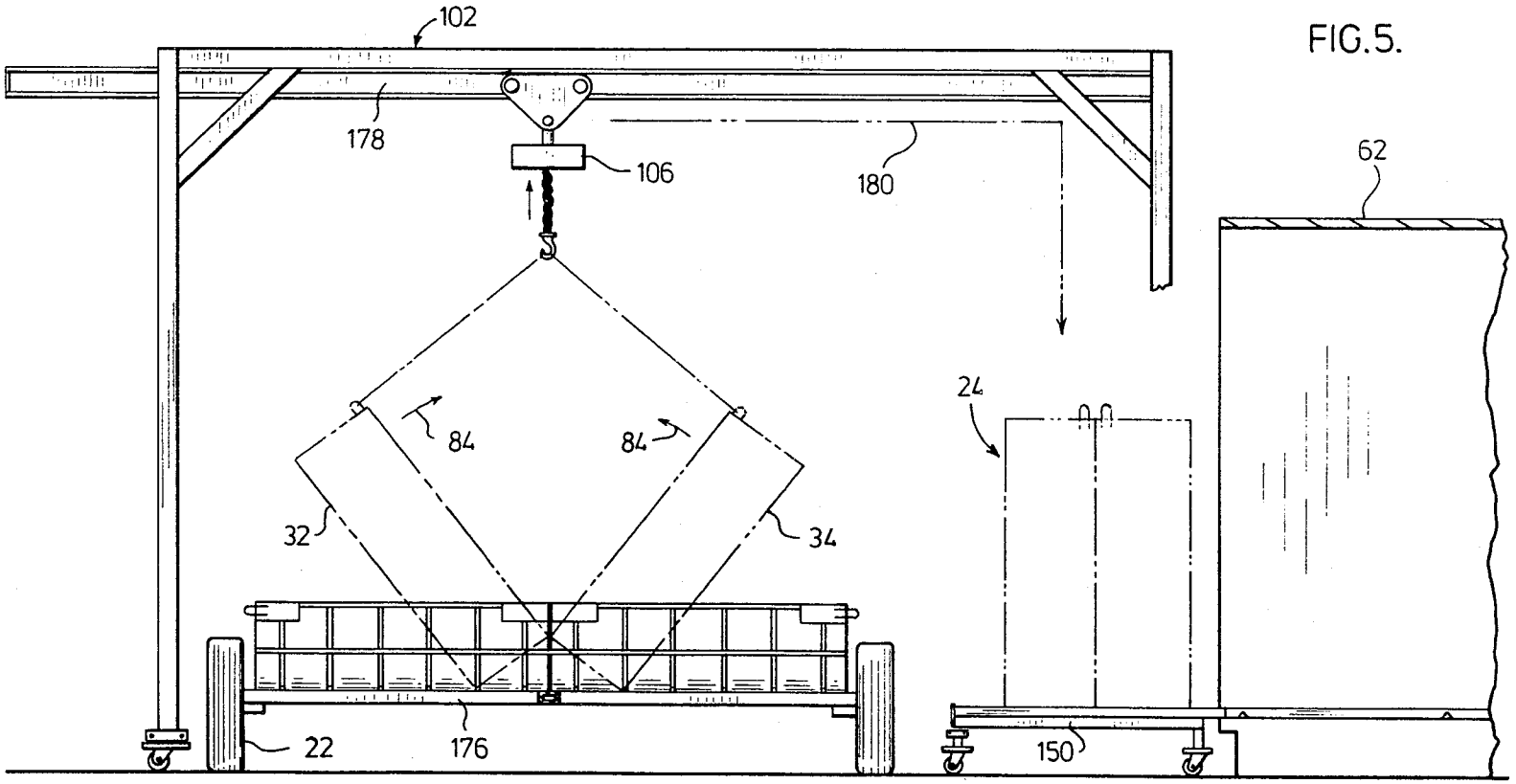
FIG. 5 shows the apparatus folding the container closed and another closed container in position ready to be picked up by a travelling crane.
Figure 6:
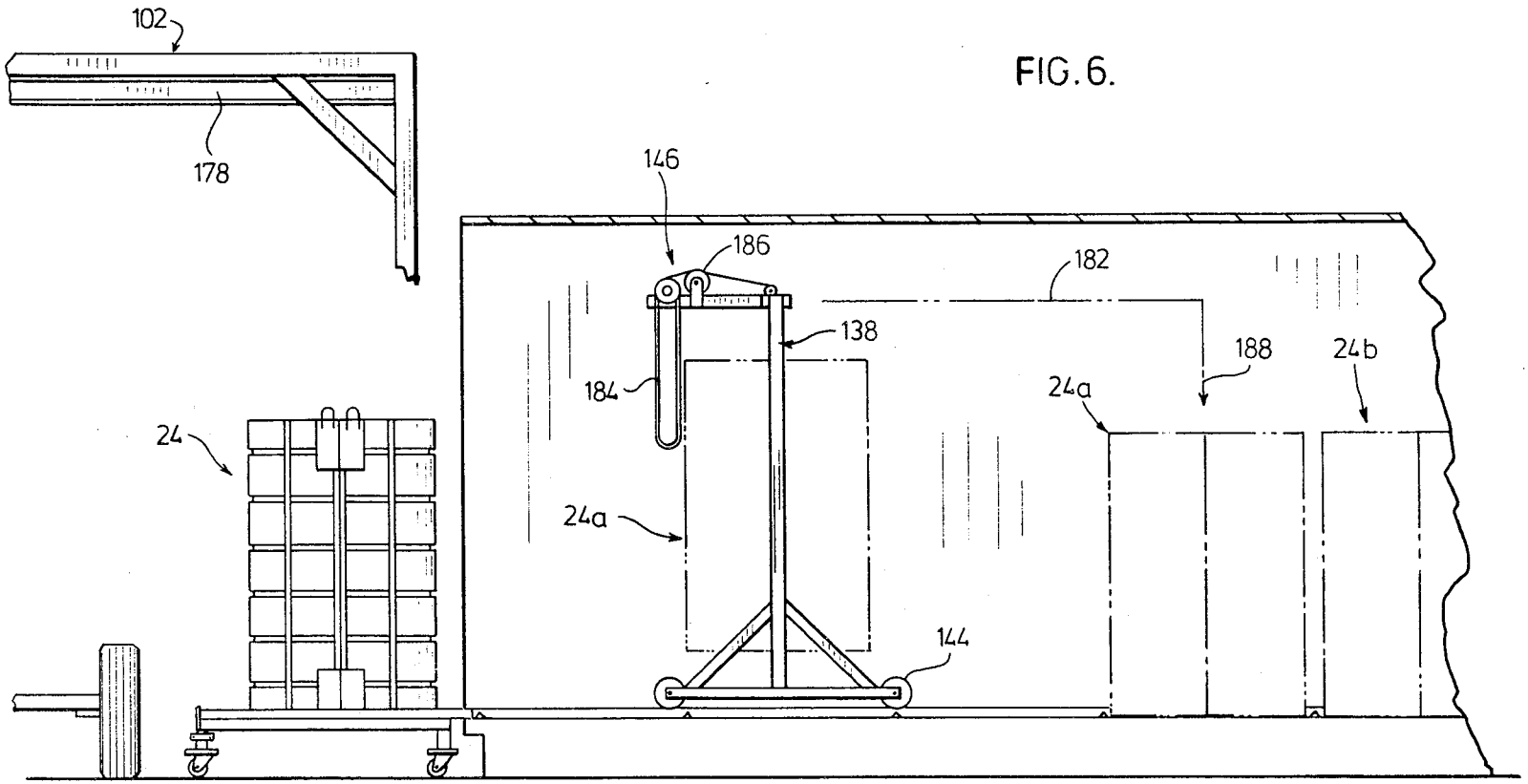
FIG. 6 shows the travelling crane having lifted a container transporting it into position for bulk cure in the kiln.
Figure 7:
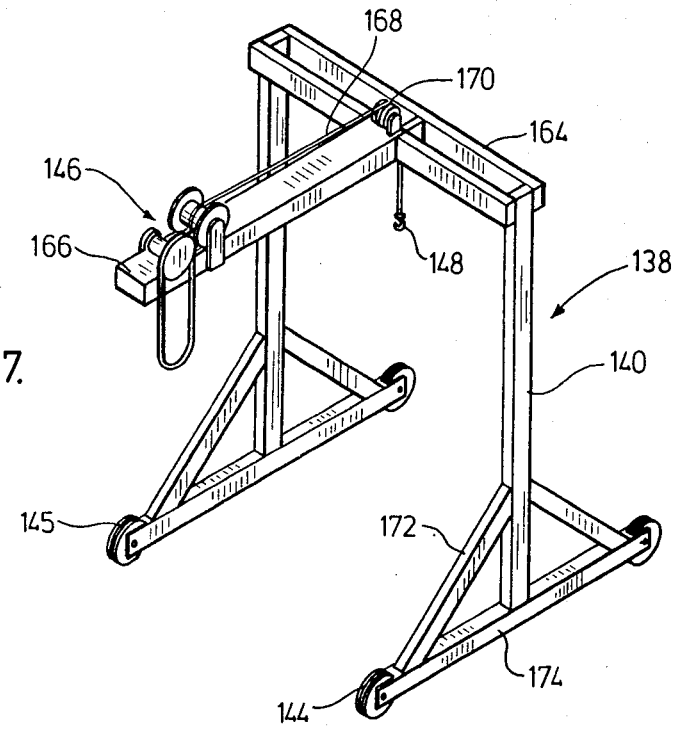
FIG. 7 shows the travelling crane for use in lifting and transporting containers into the kiln.

Due to the mobility of the overhead crane 102, it is movable up to and may be placed against the kiln entrance area in the manner shown in FIGS. 4, 5 and 6. The crane 102 can place a folded container onto the platform 162 of the mobile frame for the gantry crane 138. Turning to FIG. 7, further detail of the gantry crane 138 is shown, wherein the overhead support 162 has cantileverly mounted thereto an outwardly extending arm 166 which supports the winch 146. The winch has a cable 168 trained over pulley 170 to provide downwardly depending cable hook 148 for securement to a bin. The downwardly depending legs 140 include brace members 172 which secure lateral arms 174 in position with the wheels 144 provided at their free ends. As a result, the gantry crane may be manually pushed to roll along the rail portions 154, 156 of the mobile frame 150.

Turning to FIG. 5, the overhead crane 102 is swinging the bin sections together in the directions of arrows 84. The folding and securing of the bin takes place on the trailer platform 176. With the bin folded and clamped in position, the overhead crane 102 is moved along the rail portions 178 in the direction of arrow 180 and lower the closed container 24 onto the platform 162 supported by mobile frame 150. Container 24 is now in position to be picked up by the gantry crane for location in a desired floor compartment of the kiln 62.

As shown in FIG. 6, the folded secured container 24 is in readiness for transfer, whereas the gantry crane 138 has already lifted a secured container **24*a* and is transporting it into the kiln in the direction of arrow 182. The winch 146 on the gantry crane 138 may be manually operable by looped chain 184 which rotates the winch drum 186. With the bin 24*a* raised, the wheels 144, as provided with annular grooves 145 as shown in FIG. 7, cooperate with the apexes of the rails to permit the gantry crane to roll smoothly along the rails into the kiln in the direction of arrow 182. Once a desired unoccupied compartment of the floor has been selected, the crane is moved to position the container 24*a* over the location and then lower it in the direction of arrow 188 to locate the container for bulk forced air cure as in container 24*b***.

The flooring arrangement for the kiln, as already described with respect to FIG. 3, may have its rails or its partitions 124, 126 and 128 and cross-members 130 triangular-shaped or in the form of inverted angle iron to provide a plurality of sloped surfaces. Details of this flooring arrangement are shown in FIG. 9. The rails, such as 124, present apexes 190 on which the wheels 144 of the crane roll. The cross-member partitions 130 are of similar shape, although of lesser height to permit the wheels 144 of the crane to roll smoothly along the rails 124, etc. without interference with the apexes of the cross-members. The floor of the kiln is supported above an air plenum generally designated 192.

In this embodiment, the flooring structure consists of a plurality of perforated panels 194, having elongate slits 196 formed therein. A particular type of floor connection is shown in FIG. 9 to form interengaging J-shaped joints generally designated 198. The J-shaped joints ensure interengagement of the panels as they are supported above the air plenum 192.

The rails and cross-members, therefore, in this embodiment overlie the supported perforated floor. Adjacent to the perimeter of each compartment floor, or around the interior of the partitions for the various compartments 122, is a sealing means in the form of resilient foam strips 200 which serve to effect a seal between container bottom 86 and kiln perforated flooring 194. The foam strips may be of any suitable foam which can withstand the kiln curing and drying temperatures. To limit the extent to which the foam is compressed, in this embodiment, a spacer means in the form of tabs 202 are provided beneath the foam to determine foam compression between such tabs. These tabs may also be used to secure the partition to the floor.

Figure 10:
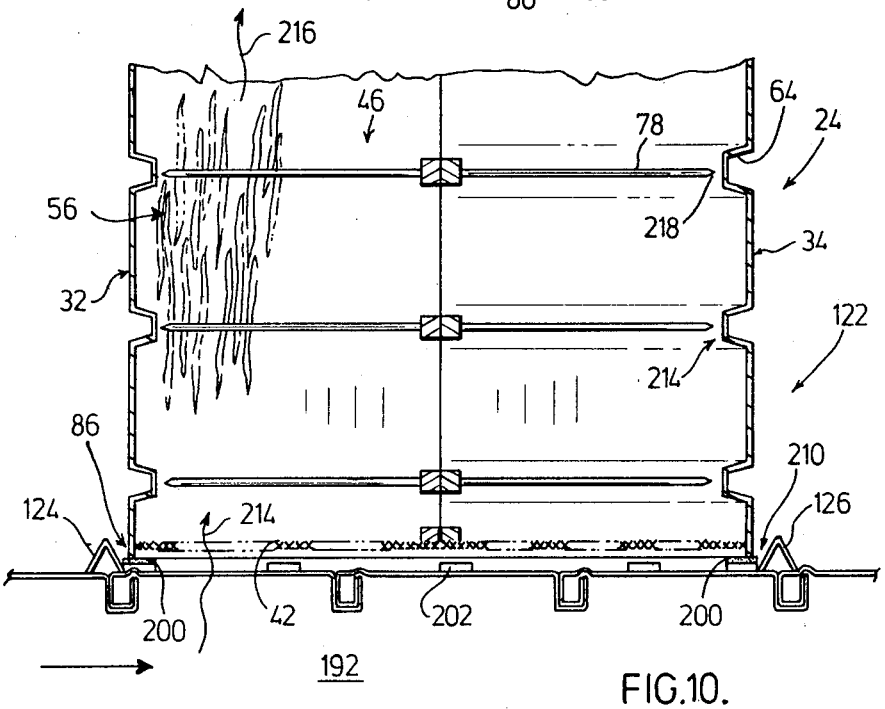
FIG. 10 shows the closed container with bulk form leaves in position on the floor of a kiln with forced air passing therethrough.
Figure 11:
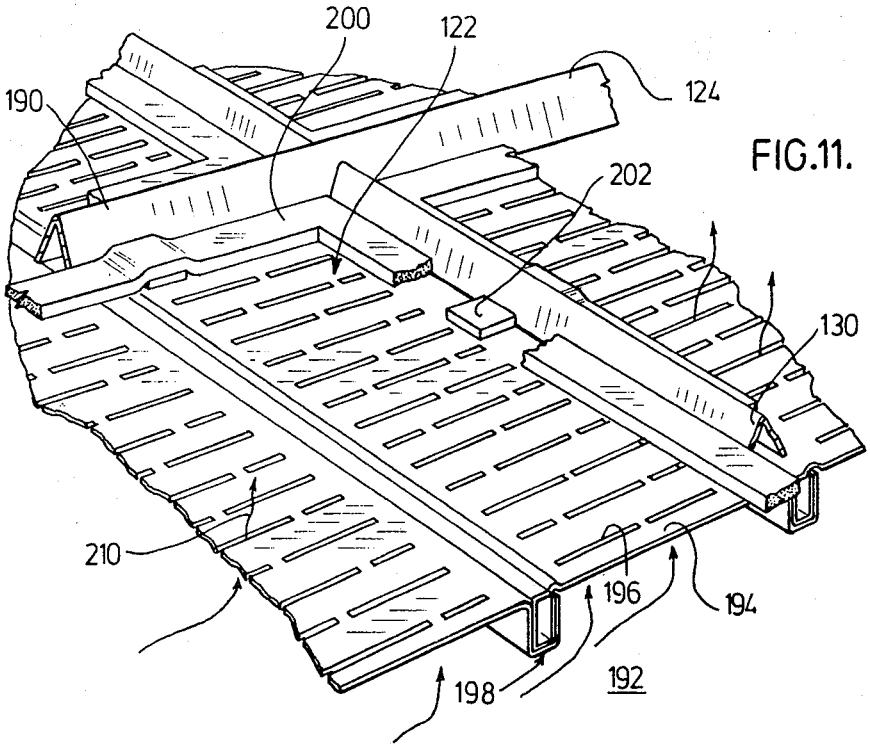
FIG. 11 shows in detail a portion of the floor arrangement for the kiln.
Figure 12:
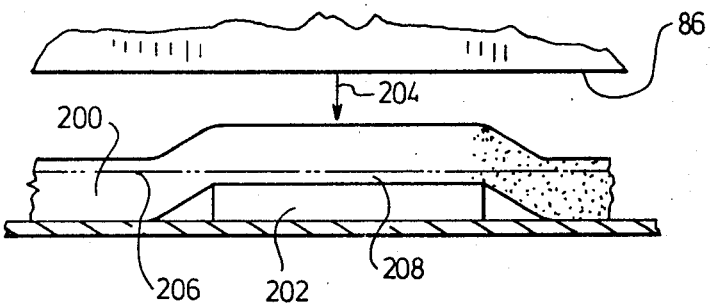
FIG. 12 shows in section a detail of the base of the container lowering onto a resilient foam sealing means for sealing container bottom.

As shown in FIG. 12, the container bottom 25 is being lowered in the direction of arrow 204 into the compartment or cavity 200 defined by the partitions. The foam strip 200 is compressed to the extent generally shown by dotted line 206 as the container base compresses the foam to a greater degree in areas 208. Therefore, the extent of foam compression is the distance approximately equal to the thickness of the tab and the extent to which the foam is compressed in area 208. Due to the fact that the crane eliminates a need for wheels on the bin, the container bottom can, therefore, be positioned very close to the perforated flooring 194 of the kiln and with the additional aspect of the sealing means 200, this ensures that substantially all air directed upwardly in the direction of arrows 210, as shown in FIG. 10, enter the base of the container to effect a more efficient cure of the tobacco. A preferred spacing for container bottom from floor is approximately one-quarter of an inch, which requires that the tabs 202 be of approximately the same thickness.

Although it is preferred to use partitions to define compartments in which containers may be located, it is appreciated that several other flooring arrangements may be used to designate or indicate location about the kiln floor where containers may be placed to effect seal between container bottom and floor. Further, sealing devices may be attached to the container bottom, such that when placed anywhere about the kiln floor, a seal is effected between floor and container to accomplish the individualized aspect of providing curing air for each container. As can be appreciated, however, the partitions provide a simple solution to the aspect of a rail network for the crane used to place containers in the kiln and in defining in a organized manner kiln floor bin locations.

With respect to FIG. 10, and the compartmentalization formed by the dividers, it can be appreciated that with this preferred arrangement, the shape of the rails and cross-members, in providing the sloped surfaces as generally designated 21, serve to guide the lowering of container bottom generally designated 86 into a respective compartment 122. In other words, the partitions in defining a cavity, also present guidance means for guiding the lowering of the container by the crane 138 onto the sealing pads 200 to ensure proper sealing engagement between the container bottom 86 and the kiln floor. In addition, the members 124, 126 also provide rails on which the rollers 144, having the annular grooves 145, easily ride, so that in a single rail and cross-member arrangement, both guidance for container lowering and means on which the crane may travel are provided.

Due to the symmetry of the formed container sections 32, 34, as shown in FIGS. 9 and 10, the channel-shaped recesses 64 which have been roll-formed into the section, align to define in a closed container circumferentially extending parallel recesses. Interiorly of the container, such recesses define a plurality of circumferentially extending projections generally designated 214. Such projections provide a significant advantage over existing bulk form containers which have smooth sidewalls because they constitute obstructions to the flow of forced air along the sidewall of the container.

As mentioned with respect to the mechanical distribution of leaves in the bin, the distributor may be controlled such that it achieves a higher density of leaves about the sidewall and base of the open container. Thus, when the container is closed, a higher density will, therefore, be achieved about the periphery of the upright container. This higher density, in combination with the projections on container sidewall interior, the container rounded corners, substantially reduces the likelihood of any channelling developing along container sidewalls during at least the yellowing stage of the tobacco cure process.

Referring more particularly to FIG. 10, the plenum 192 is supplied with pressurized air which by way of the apertures 196 in the place permits the forced air to travel upwardly in the general direction of arrows 214, 216. As already explained, the spiking devices 46 are secured in a manner with their base portions abutting, to hold the bulk form tobacco leaves 56 oriented generally in a vertical direction to permit air to pass upwardly therethrough to effect proper cure. In the central region generally designated 216 of the closed container, the density of the tobacco is essentially uniform. Along the sidewalls, as explained, the projections 214 serve to define in combination with the bulk form tobacco, a turtuous path along which air flow in direction of arrow 214 must pass. This impeding of the air flow, therefore, reduces the chances of channelling of the air up the sidewalls and provides a more uniform flow of air upwardly through the bulk form of tobacco.

The perforated floor, in combination with bins sealingly engaged therewith, provides a substantial advantage over the span of curing tobacco and conditioning tobacco. The perforated floor provides an equalization of pressure throughout the plenum and provides a sufficiently high flow of air to achieve proper yellowing of the tobacco, yet maintain sufficiently low air velocities to avoid premature greening of the tobacco. This individual directing of air flow through the various containers on the kiln floor more evenly distributes the forced air from the plenum through the several containers. Should a significant channelling problem develop in any one of the bins, or a break in one of the seals, the perforated floor is designed to limit the flow rate of air through that particular floor location or compartment. The other compartments are not, therefore, appreciably starved of forced air so that the cure is continued in the remaining containers. This may be compared to a parallel circuit arrangement where the resistance to flow of air through each circuit, that is, each bin, is determined by the design of the perforated floor and the density of the tobacco in the bin. It is, therefore, desired to provide a resistance in the circuit, due to the perforated floor, which prevents an unimpeded flow of air through that compartment or area when a container seal is faulty, a channelling problem develops or any other development which could conceivably allow the air to flow freely away from the upper surface of the floor. Therefore, during a natural curing of the tobacco, the perforated floor plays a role in the curing as the tobacco "flops", since it continues to equalize the flow of air through the various containers, even though there may be a discrepancy in the resistance to flow of air through the various containers which may cure out differently. As a result, a more uniform cure is obtained in each container due to what may be considered an individual flow of cure air for each compartment.

This advantage of the kiln floor may also be considered as follows. Should any one of the containers cure out faster than the others, whereby its bulk form tobacco has shrunk or "flopped", then there is less resistance to flow of forced air therethrough. However, the air flow is restricted by the perforated floor, so that other containers are not starved of curing air. For example, during a representative cure, the initial static pressure in the plenum is much greater than when the tobacco has "flopped". Therefore, should any one of the containers cure faster, this drop in static pressure through the cured contained tobacco does not appreciably affect the curing of the remaining containers in the other compartments or cavities of the kiln floor.

This aspect of the floor arrangement provides a relatively low air velocity, yet high flow volume of curing air. The uniform distribution of forced air over the base of the container and the avoidance of relatively low density of tobacco in the bin all contribute to increase the efficiency of bulk cure of tobacco.

It is appreciated that, in roll forming the container shell sections 32, 34, various other types of projections may be provided on the container sidewall interior to impede the flow of air up the sidewalls between bulk form tobacco and container interior.

As shown in FIG. 10, the spiking devices 46 have their prong or spike members 78, as they impale the bulk form leaves, extending towards the recesses 64, but short thereof to define a space 218 between prong ends and the projections 214. This eliminates a need for the spike ends to fit into a supporting recess or the like, thereby facilitating spike insertion. All the support needed for the spiking devices is provided by the cooperating fit between the legs 74 and the recesses 64. The relationship of the spike ends to the projections is such to prevent leaves along the sidewall of the container flopping or sliding down. The projections serve to block the sliding of leaves along the sidewalls when the container is upright and to avoid low leaf density areas so as to prevent channelling of forced air during cure.

The provision of recesses in the roll-formed sidewalls of the relatively light container shells substantially enhance their structural strength. In combination with the aspect of the recesses providing supporting sockets for the spiking devices and minimizing channelling, they give a bulk tobacco container which has increased curing efficiencies. Such container design also permits a great deal of flexibility in terms of container arrangement for use in the kilns and as a result, may be tailor made to particular tobacco farming requirements, which are not readily achieved by the prior art systems involving welding of the container structure.

After drying of the tobacco has been completed the tobacco is then subjected to the conditioning phase to raise its moisture contact back up to a suitable level to permit handling. Due to the somewhat individualized flow of forced air through the various containers in the kiln, it is possible with this kiln floor arrangement to remove only some of the containers from the kiln after they have been conditioned. This may arise when it is impossible to remove from the kiln at once all containers, transfer them to a stripping room, grade them and bale them before the tobacco begins to dry out in the kiln. To avoid this, some of the containers are, therefore, removed from the kiln while the remaining containers remain in the kiln and the conditioning process is continued, because the perforated floor still maintains an appreciable flow of conditioning air through the containers remaining in the kiln. Therefore, any number of containers may be taken out at a time from the kiln without appreciably affecting the movement of conditioning air through the remaining containers in the kiln.

In removing the containers from the kiln, the gantry crane 138 may be used. Due to the mobility of the frame 150, it may be switched from side to side of the kiln or from a single row at once. In removing the containers from kiln, the removable platform portion 162 and cross-brace 163 may be removed to permit some other devices, such as a forklift truck, to move in, lift the bulk from container and transport it to another area for collection of cured tobacco.

In locating the empty containers, they may be placed at the outboard side of the overhead crane 120. As shown in FIG. 5, the rail 178 extends outwardly beyond the overhead 102 to permit picking up of any empty container by the winch 106, moving it over the placing it on top of the trailer bed 176 before such trailer is towed back to the field.

The kiln floor arrangement has another advantage, in that, due to its sealing of the container, bottoms, there is no need to provide seals along the kiln sidewalls or across the kiln top. All of the sealing action in the kiln takes place on the kiln floor. This substantially simplifies kiln design and makes for a more open overhead area, particularly in view of the use of a straddle type crane 138 which eliminates the costly and heavy overhead crane tracks placed in kilns of prior art devices.

It is also appeciated that, in instances where it is desired to provide a wider kiln, then more rails may be provided to define three or more rows of compartments in the kiln. A further consideration is that the kiln floor arrangement may be used with any type of bulk tobacco bin which has a bottom adapted to fit into the various compartments. Also, the gantry crane is usable with any type of kiln which has the necessary rails along the floor, for positioning bulk tobacco containers in a kiln.

Therefore, a system has been described with respect to the preferred embodiments for minimizing the manual handling of tobacco leaves during harvest and cure, facilitates bulk tobacco container handling and simplifies the overall mechanization of tobacco curing and harvesting.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A container shell for bulk cure of tobacco leaves, said container having top and bottom adapted to permit passage of forced air through it when loaded with tobacco leaves in bulk form, means associated with said shell for holding such bulk form of leaves in said shell during leaf cure, said shell comprising essentially identical roll-formed sections connected by a common hinge and swingable to a closed position to form said shell, each section being U-shaped and having laterally extending recesses roll-formed therein where each section corner is rounded to provide a curved interior corner, said laterally extending recesses defining on shell interior a plurality of obstructions to forced air alongside shell interior when loaded in bulk form with such tobacco leaves.

2. A container shell of claim 1, wherein said means for holding leaves in bulk form in position comprises a plurality of spiking devices which pierce the leaves in bulk form, each spiking device having base and outwardly extending spaced-apart legs, a plurality of outwardly extending spaced-apart spikes secured at their roots to said base between said legs, said legs and shell recesses being of mating configuration to permit said legs to move along said recesses as said spikes pierce tobacco leaves in moving toward section base, means for preventing said legs twisting out of engagement with said recesses when shell sections are loaded with bulk form tobacco leaves and said section bases are lying essentially in vertical planes whereby bulk form tobacco is held in position for forced air cure in a kiln.

3. A container shell of claim 2, wherein said means for preventing disengagement of legs from recesses comprises a strap means secured to and overlying each corresponding recess of said shell section.

4. A container shell of claim 1, wherein the end portions of shell sections which define container bottom, when the shell sections are swung together, include wire mesh.

5. A container shell of claim 4, wherein said end portions having the wire mesh are connected by the common hinge.

6. A container shell of claim 5, wherein the end portions of the shell sections, which are remote from the hinged area, have a pair of connectors to which a lifting device may be connected for lifting the shell sections in closing them and for transporting the closed shell.

7. A container shell of claim 1, wherein said shell section recesses additionally receive standards for charge plates about the perimeter of each open section when located on a harvester to permit distribution of leaves therein to levels above the height of said open sections.

8. A method of making a container adapted for use in the bulk cure of tobacco leaves, comprising roll forming two essentially identical container sections with a plurality of longitudinally extending recesses, bending each section into a U-shaped section with recesses forming projections into the U-shaped section and each section corner being rounded, connecting the two sections by a common hinge bridging aligned end portions of the sections, interconnecting the upright portions of each U-shaped section remote from the hinged area, and applying confinement means over the recesses to confine in said recesses support frame legs of spiking members used to hold bulk form tobacco lying in such open container.

9. An apparatus for use with a bulk cure tobacco kiln having at least two spaced-apart rails extending from kiln entrance to its back, such rails overlying a kiln perforated flooring, said apparatus comprising a movable frame supporting a pair of parallel spaced-apart rails adapted to be interconnectable with any pair of such kiln rails, a gantry crane having wheels associated with its depending legs for rolling engagement with said rails on said frame, said gantry crane being adapted to raise a bulk loaded tobacco container from said mobile frame, transport it into a kiln having such corresponding rails and lower such carried container to rest its bottom onto a desired kiln floor location between said rails.

10. An apparatus of claim 9, wherein said gantry crane has a manually operable winch for raising and lowering bulk loaded tobacco containers.

11. An apparatus of claim 9, wherein said mobile frame rails are angle iron disposed with their apexes upward, said gantry crane wheels having annular grooves to engage said angle iron.

12. An apparatus of claim 9, wherein a platform is removably secured to said frame.

13. An apparatus of claim 9, wherein said frame has wheels mounted on depending legs to facilitate frame mobility.

14. In combination, a forced air bulk cure tobacco kiln, containers adapted to support bulk form tobacco with leaves oriented generally vertical and having open bottom and top, a mobile frame onto which a container crane travels, said kiln comprising perforated floor supported above an air pressurized plenum, at least two parallel equally spaced-apart rails extending along and overlying said kiln floor, a plurality of dividers intersecting said rails to define at least two rows of cavities, each cavity being adapted to receive a container bottom and sealingly engage same, said mobile frame supporting bulk loaded containers, where said rails are adapted for operable connection to any pair of rails in said kiln, said container crane having depending legs to straddle a container resting on said frame where wheels associated with said legs are adapted to engage said rails, said crane lifting said container, being manually movable to transport said container in the upright position to an unoccupied cavity and lowering said container into sealing engagement with said perforated floor within such cavity.

15. In the combination of claim 14, said rails being inverted angle iron where the wheels of the container crane have annular grooves to engage the apexes of the rails.

16. In the combination of claim 15, the apexes of the angle iron rails being located above the dividers intersecting the rails to permit the container crane wheels to smoothly travel along the rails.

17. In the combination of claim 15, said dividers being inverted angle iron of a height less than the angle iron rails, the sloped surfaces of the rails and partitions guiding the lowering of container bottom into a respective unoccupied cavity.

18. In the combination of claim 17, strips of compressible foam secured to perforated kiln floor about its periphery within a cavity and means for limiting the extent to which said foam is compressed when container bottom is located in the cavity.

19. In the combination of claim 14, means for providing a seal between perforated kiln floor and container bottom, such sealing means extending about the perimeter of the kiln floor located in a respective cavity.

20. In the combination of claim 18, a plurality of spaced tabs underlying the foam strips, the thickness of the tabs determining the extent to which the foam between tabs is compressed and the space between container bottom and perforated kiln floor.

21. A system for minimizing physical handling of tobacco leaves during harvest and bulk curing thereof, comprising a mechanical harvester for removing leaves from one or more rows of tobacco plants as it travels over a field, conveyor means on said harvester for conveying removed leaves rearwardly and upwardly of the machine to leaf distributor means, a container adapted for bulk cure of tobacco resting on a trailer elevated at the rear of said harvester above anticipated tobacco plant height with container located beneath said leaf distributor means, said container comprising two sections connected by a common hinge with removable charge plates about the periphery of said container and along said hinge to define two compartments into which leaves are to be distributed, said leaf distributor means distributing removed conveyed leaves in said two container compartments to level determined by the height of said removable charge plates, means on said harvester for lowering said trailer to ground level to permit transport of said container when bulk filled to kiln location, such transport of container effecting a settling of leaves in said container compartments, a plurality of spike members being inserted into said compartments to pierce said leaves in bulk form, said spike members carried by frames associated with said container to retain said spike members in an essentially horizontal plane when said container is folded closed, an overhead container folding crane adapted for connection to container portions remote of said hinge to raise container sections and fold them toward one another as said container portions are raised, clamp means for holding container sections closed whereby tobacco leaves in bulk form held in said container by said spike members are generally vertically oriented, said overhead crane operable to place said clamped container on a mobile frame exterior of a kiln entrance, said kiln having a flooring arrangement comprising a perforated floor supported above an air plenum, spaced-apart rails extending from kiln entrance to its back, a plurality of cross-members extending between said rails to define at least two rows of cavities, each cavity being adapted to receive the bottom of said closed container, the container top and bottom being adapted to permit a flow of forced air through said container, means for sealing container bottom periphery to perforated floor to direct air forced through said perforated floor into said container, said mobile frame having a pair of rails interconnected with corresponding pairs of kiln rails, a gantry crane having wheels engagable with said rails to permit gantry crane movement from platform to back of kiln, said gantry crane adapted to lift said closed container, transport it to an unoccupied cavity and lower container bottom into sealing engagement with said perforated floor, said kiln with entrance closed being adapted to effect a forced air cure of bulk form tobacco in containers occupying all of said cavities.

22. A system of claim 21, wherein said container has its sections hinged about their bottom end portions to provide an upright container when sections are folded to closed position.

23. A system of claim 22, wherein the bin sidewalls have a plurality of projections to define internally thereof a plurality of obstructions which impede the flow of air along container sidewall interior when loaded in bulk form with tobacco leaves.

24. A system of claim 21, wherein said overhead container folding crane is supported in a manner to permit trailing of container beneath the crane and permit folding of the sections and thus closure of the container of the trailer.

25. A system of claim 21, wherein said rails are each inverted angle iron and the wheels of the gantry crane have annular grooves to cooperate with said angle iron rails for gantry crane movement.

26. A system of claim 21, wherein said sealing means comprises strips of compressible foam secured to perforated floor abouts its periphery defined along each cavity wall.

27. A system of claim 26, wherein means is provided to determine the extent to which the foam is compressed and the space between container bottom and kiln perforated floor.

28. A system of claim 21, wherein said rails are formed of inverted angle iron of greater height than the cross- members which are inverted angle iron, the higher rails permitting unimpeded passage of wheels along such rails, the sloped surfaces of rails and cross members guiding the lowering of container bottom into an unoccupied cavity.

29. A system of claim 27, wherein said means spaces container bottom from perforated kiln floor approximately one-quarter of an inch.

30. A system of claim 29, wherein metal tabs are located beneath the foam strips to thereby determine the extent to which foam between tabs is compressed, the thickness of each tab being approximately one-quarter of an inch.

* * * * *